US012116857B2

(12) United States Patent
Soma et al.

(10) Patent No.: US 12,116,857 B2
(45) Date of Patent: Oct. 15, 2024

(54) WELL ACCESS APPARATUS AND METHOD

(71) Applicant: Annulus Intervention System AS, Tananger (NO)

(72) Inventors: Espen Soma, Sandnes (NO); Tomas Solvig, Sola (NO)

(73) Assignee: Annulus Intervention System AS, Tananger (NO)

( * ) Notice: Subject to any disclaimer, the term of this patent is extended or adjusted under 35 U.S.C. 154(b) by 53 days.

(21) Appl. No.: 17/920,932

(22) PCT Filed: Apr. 22, 2021

(86) PCT No.: PCT/EP2021/060526
§ 371 (c)(1),
(2) Date: Oct. 24, 2022

(87) PCT Pub. No.: WO2021/214216
PCT Pub. Date: Oct. 28, 2021

(65) Prior Publication Data

US 2023/0313631 A1 Oct. 5, 2023

(30) Foreign Application Priority Data

Apr. 22, 2020 (NO) ..... 20200485

(51) Int. Cl.
*E21B 33/068* (2006.01)

(52) U.S. Cl.
CPC ..... *E21B 33/068* (2013.01)

(58) Field of Classification Search
CPC ..... E21B 33/068
See application file for complete search history.

(56) References Cited

U.S. PATENT DOCUMENTS

| | | | | |
|---|---|---|---|---|
| 6,186,239 | B1 | 2/2001 | Monjure | |
| 9,782,813 | B2 * | 10/2017 | Sorensen | E21B 19/22 |
| 11,306,553 | B2 * | 4/2022 | Sorensen | E21B 19/22 |
| 11,313,197 | B2 * | 4/2022 | Sorensen | E21B 33/068 |
| 2019/0389038 | A1 | 12/2019 | Sorensen | |
| 2020/0063514 | A1 | 2/2020 | Sorensen | |
| 2021/0102437 | A1 | 4/2021 | Sorensen | |

* cited by examiner

*Primary Examiner* — Jonathan Malikasim
(74) *Attorney, Agent, or Firm* — Getz Balich LLC

(57) ABSTRACT

An intervention apparatus for gaining lateral access to a well via a lateral access passage of the well is provided, including an outer pipe and a flexible guide pipe for guiding a flexible conduit towards the lateral access passage, the flexible guide pipe being arranged to be forwardly advanced in the outer pipe and to deform around a bend in the outer pipe as it is forwardly advanced.

10 Claims, 3 Drawing Sheets

WELL ACCESS APPARATUS AND METHOD

This application claims priority to PCT Patent Appln. No. PCT/EP2021/060526 filed Apr. 22, 2021, which claims priority to Norwegian Patent Appln. No. 20200485 filed Apr. 22, 2020, which are hereby incorporated herein by reference in their entireties.

BACKGROUND OF THE INVENTION

1. Technical Field

The invention relates to apparatus and a method for gaining lateral access to a well via a lateral access passage of the well.

2. Background Information

Wells created for oil and gas production have a casing with an annulus inside the casing. However, in some wells problems have developed over time in the annulus which require intervention. For example, at the bottom of the annulus, the cement starts cracking and micro-cracks enable gas from the formation outside the cement to migrate through the cement. The gas overcomes the hydrostatic pressure of liquid in the annulus and having entered the annulus it migrates upwardly and increases the pressure within the casing. This is called shut-in casing pressure. There has been increasing concern about shut-in pressure, and regulations are getting stricter in some regions.

To alleviate the pressure, the gas is bled off. However, when bleeding down the gas pressure, at some point there will also be bleed of fluid, making the fluid column smaller and increasing the pressure problem. To get more fluid into the annulus the most common method is the use of alternating steps of bleeding off the gas and pumping in fluid to top up the annulus with fluid. With this method, the annulus is pressurized in cycles and risks to damage the cement further.

Wells often have at least one lateral access passage which provides for communication between the inside of the well and the outside. If this lateral access passage is used for pumping in fluid while bleeding off gas at a higher point both these steps may be carried out simultaneously to avoid the pressure cycles.

Most onshore wells emerge from the ground into a pit surrounded by a concrete wall. If leakages occur spills will be contained in the pit. When the wells were drilled, it was acceptable for a lateral inlet passage to the annulus around the well casing to be underground because there was no service operation which required rig-up space on the annulus inlet passage when the well was drilled. As long as there was enough space to allow entry of a hose for pumping fluid into the well that was sufficient. More recently, if it is desired to gain access to the lateral inlet passage, it may be necessary to dig out the wall to create more space for an intervention tool to feed a hose along the lateral inlet passage and into the well.

It is known from WO2018/154087 to provide apparatus for gaining access to a well via a lateral access passage which comprises a flexible hose which is to be inserted into the well via the lateral access passage so as to deviate from a direction of lateral insertion to a generally downward direction down the well.

SUMMARY

Viewed from one aspect, the invention provides intervention apparatus for gaining lateral access to a well via a lateral access passage of the well, comprising an outer pipe and a flexible guide pipe for guiding a flexible conduit towards the lateral access passage, the flexible guide pipe being arranged to be forwardly advanced in the outer pipe and to deform around a bend in the outer pipe as it is forwardly advanced.

Viewed from another aspect, the invention provides a method for gaining lateral access to a well via a lateral access passage of the well, comprising connecting intervention apparatus to the well, the intervention apparatus comprising an outer pipe and a flexible guide pipe, forwardly advancing the flexible guide pipe in the outer pipe towards the well such that the flexible guide pipe deforms around a bend in the outer pipe as it is forwardly advanced, and guiding a flexible conduit along the flexible guide pipe towards the lateral access passage.

This arrangement allows the intervention apparatus to occupy less space radially outwardly of the well than in known systems. Therefore, the intervention apparatus and the methods are useful in interventions where there is limited space.

In the case of wells where access is desired via a lateral access passage in a pit surrounded by a concrete wall, space radially outwardly of the well may be limited by the wall and so the apparatus and method is useful in avoiding or minimizing the need to dig out the wall to increase space.

The flexible guide pipe may comprise a flexible tube, for example made of a polymer, with or without steel or other reinforcement. The flexible guide pipe may comprise a plurality of links or knuckles pivotally connected together to enable flexing.

The flexible conduit may comprise a flexible hose, for example made of a polymer, with or without steel or other reinforcement.

At the forward end of the flexible guide pipe various devices may be provided, for example to assist delivery of the flexible conduit through the lateral access passage and/or to direct the flexible conduit in an appropriate direction in the well.

A bending head may be provided in front of the flexible guide pipe to direct the flexible conduit into the well from a direction of lateral insertion to another direction. The direction of lateral insertion is a lateral direction with respect to the well. The bending head may be made from a rigid material.

In such an arrangement, the flexible guide pipe can be used to advance the bending head towards the lateral access passage, and preferably into the lateral access passage. Thus the flexible guide pipe can deviate or flex around the bend in the outer pipe and also transmit a forward pushing force to the bending head. When it is desired to retract the bending head, preferably the flexible guide pipe can pull it rearwardly.

The intervention apparatus may be configured so that when the flexible guide pipe is in a retracted position prior to forward advancement, the bending head is located forwardly of the bend in the outer pipe. In this arrangement, it is not necessary for the bending head to pass around the bend in the outer pipe during its forward advancement towards the lateral access passage. The provision of a guide pipe which is flexible means that it is this flexible guide pipe which passes around the bend and is capable of being advanced forwardly while flexing or deviating at the bend. The intervention apparatus may provide a straight pathway for the bending head as it moves forwardly when the flexible guide pipe is forwardly advanced. The bending head can therefore be made from a rigid material, which may help to ensure that it performs consistently in directing the flexible conduit in an appropriate direction in the well.

The other direction to which the flexible conduit is directed by the bending head may be a circumferential direction with respect to the well. Thus for example it may be a horizontal direction. This may be useful if it is desired to direct the flexible conduit circumferentially around the annulus, for example to discharge sealant into the annulus. If the outlet end of the flexible conduit is initially advanced one revolution around the annulus, it may be withdrawn while discharging sealant and so distribute the sealant all around the annulus.

The other direction to which the flexible conduit is directed by the bending head may alternatively be a generally downward direction.

The bending head may have a guide passage for receiving the flexible conduit and having a bend therein to deviate the flexible conduit as it enters the well. The bend may be configured to deviate the flexible conduit from the direction of lateral insertion to a circumferential direction with respect to the well, or to a generally downward direction. The method may further comprise guiding the flexible conduit along the guide passage and deviating the flexible conduit in the bend in the guide passage. The deviation may be from the direction of lateral insertion to a circumferential direction with respect to the well, or to a generally downward direction.

The bending head may be positioned in the outer pipe with the guide passage appropriately orientated, for example with an outlet pointing generally horizontally or generally downwardly. The bending head may be pre-positioned in the outer pipe with the guide passage appropriately orientated when the flexible guide pipe is in a retracted position prior to forward advancement. Thus the bending head can be in a suitable position to deviate the flexible conduit in the desired direction in the well when the bending head is forwardly advanced. The guide passage may have a rear portion extending forwardly and with a radially outward component with respect to a longitudinal centerline of the bending head, and a front portion which extends forwardly and curves radially inwardly across the longitudinal centerline to terminate so as to exit the bending head pointing in a direction with a radially outward component. The pointing direction may be a circumferential direction with respect to the well, or a generally downward direction.

The shape of the guide passage allows the radius of curvature of the front portion to be relatively large given the available width of the bending head, compared to a situation in which the rear portion did not have a radially outward (or upward) component. This minimizes the amount by which the flexible conduit has to bend when it is delivered through the guide passage.

The intervention apparatus may be configured so that when the flexible guide pipe is in a retracted position prior to forward advancement, a front part of the flexible guide pipe is located in the bend in the outer pipe. Thus the front part may be pre-bent at this stage, which means that it does not have to navigate the bend in the outer pipe when first being advanced from the retracted position.

The intervention apparatus may be configured so that when the flexible guide pipe is in a forwardly advanced position after forward advancement, a rear part of the flexible guide pipe is located in the bend in the outer pipe. Thus the rear part is bent at this stage, which means that it does not have to navigate the bend in the outer pipe when the flexible guide pipe is being retracted from the forwardly advanced position.

The outer pipe may have a first straight portion, a bent portion located forwardly of the straight portion and having the bend therein, and a second straight portion located forwardly of the bent portion.

The intervention apparatus may further comprise a tool located rearwardly of the flexible guide pipe and arranged to forwardly advance the flexible guide pipe in the outer pipe. Thus the tool may push the flexible guide pipe forwardly. Preferably, the tool can pull the flexible guide pipe rearwardly to retract it.

The bend in the outer pipe may be a 90° bend.

The intervention apparatus may further comprise the flexible conduit.

In certain applications of the invention, the apparatus and method may be used to provide continuous pumping of fluid into the annulus while bleeding off gas at a higher point to avoid the pressure cycles of the prior art while still filling the annulus with fluid and increasing the hydrostatic pressure. The method may comprise selecting the density of the fluid to achieve a desired hydrostatic pressure in the annulus, e.g. at the bottom of the annulus.

BRIEF DESCRIPTION OF THE DRAWINGS

Certain preferred embodiments of the invention will now be described, by way of example only, with reference to the accompanying drawings in which.

DETAILED DESCRIPTION OF THE INVENTION

Figure 1:
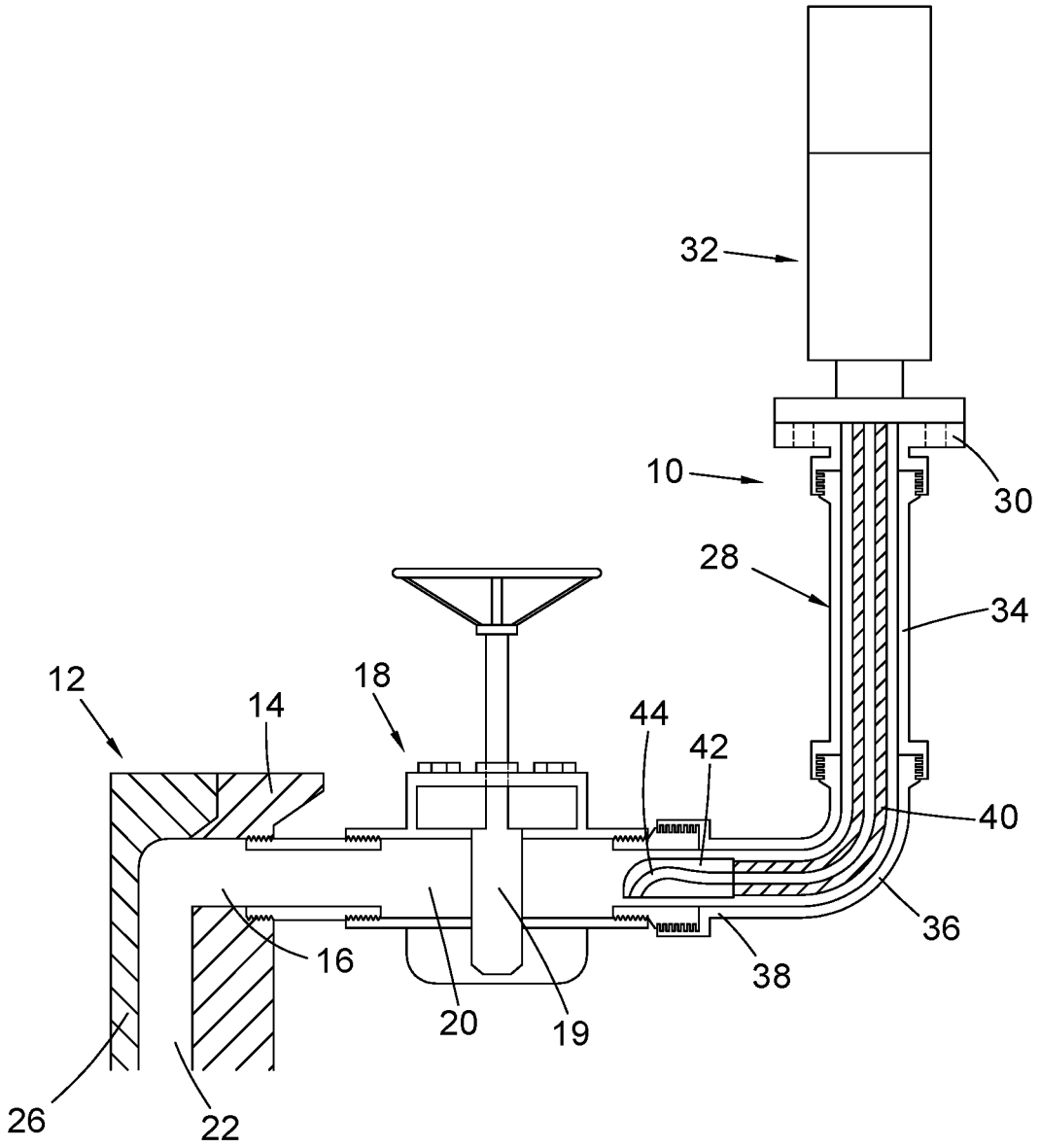
FIG. 1 is a schematic sectional view showing an embodiment of the intervention apparatus in accordance with the present invention connected to a well head and in a retracted position.

FIG. 1 shows intervention apparatus 10 connected to a well 12 of standard construction. The well 12 has an annular outer wall 14 formed with a side opening 16 and a valve 18 having therethrough a passageway 20 which is aligned with the side opening 16 in the outer wall 14. The valve 18 has a gate 19 which may be switched between open and closed positions to open or close the passageway 20. When the valve is closed, this shuts off access from outside to the well side opening 16. When it is opened, access is allowed.

The passageway 20 and the side opening 16 together form a lateral access passage, which provides access to the outside of the outer wall 14, the inside of the side opening 16, or the space radially inwardly of the side opening 16.

The well 12 has an annular cavity 22, known as the annulus, between a radially outer surface of a casing hanger 26 and an inside surface of the outer wall 14. The casing hanger 26 is in sealed engagement with the inside surface of the outer wall 14.

In this embodiment, the apparatus 10 is shown being used to gain access to the annular cavity 22 between the radially outer surface of the casing hanger 26 and the inside surface of the outer wall 14. In another use of the apparatus 10, it may gain access to an annulus between a radially outer surface of a production tubing and an outer wall. Such a production tubing may hang from a tubing hanger which is in sealed engagement with the inside surface of the outer wall.

The apparatus 10 for gaining access to the well 12 via the lateral access passage will now be described. The apparatus comprises an outer pipe 28 connected at its forward end to the valve 18 and at its rearward end, via a flange 30, to a top-up tool 32. The outer pipe 28 has a first straight portion 34 forwardly of the flange 30, a bent portion 36 forwardly of the straight portion 34, and a second straight portion 38 forwardly of the bent portion 36.

A flexible guide pipe 40 is provided inside the outer pipe 28. A bending head 42 is connected to a front end of the flexible guide pipe 40. As seen in FIG. 1, when the intervention apparatus is in the retracted position the bending head 42 is located in the second straight portion 38 of the outer pipe 28. The bending head 42 has a guide passage 44 extending from its rear end where it joins the outer pipe 28 to its front end.

A flexible conduit 46 extends from the top up tool 32, along the flexible guide pipe 40 and into the bending head 42.

The guide passage 44 of the bending head 42 has a rear portion extending generally longitudinally and radially outwardly of the bending head 42. The rear portion joins to a front portion which curves radially inwardly across a longitudinal centerline of the bending head 42 to terminate so as to exit the bending head pointing in a generally radially outward direction. From the perspective of the well 12, in this embodiment, the rear portion of the guide passage 44 extends generally laterally and upwardly to join the front portion which curves downwardly to terminate in a generally downward direction.

The shape of the guide passage 44 allows the radius of curvature of the front portion to be relatively large, compared to a situation in which the rear portion did not have a radially outward (or upward) component. This minimizes the amount by which the flexible conduit 46 has to bend.

The top-up tool may for example be in accordance with those described in WO2017/129632 or WO 2018/158402. It includes a drive mechanism which provides a stroking function, as well as a conduit via which the flexible conduit 46 may pass through the tool to the outer pipe 28.

Figure 2:
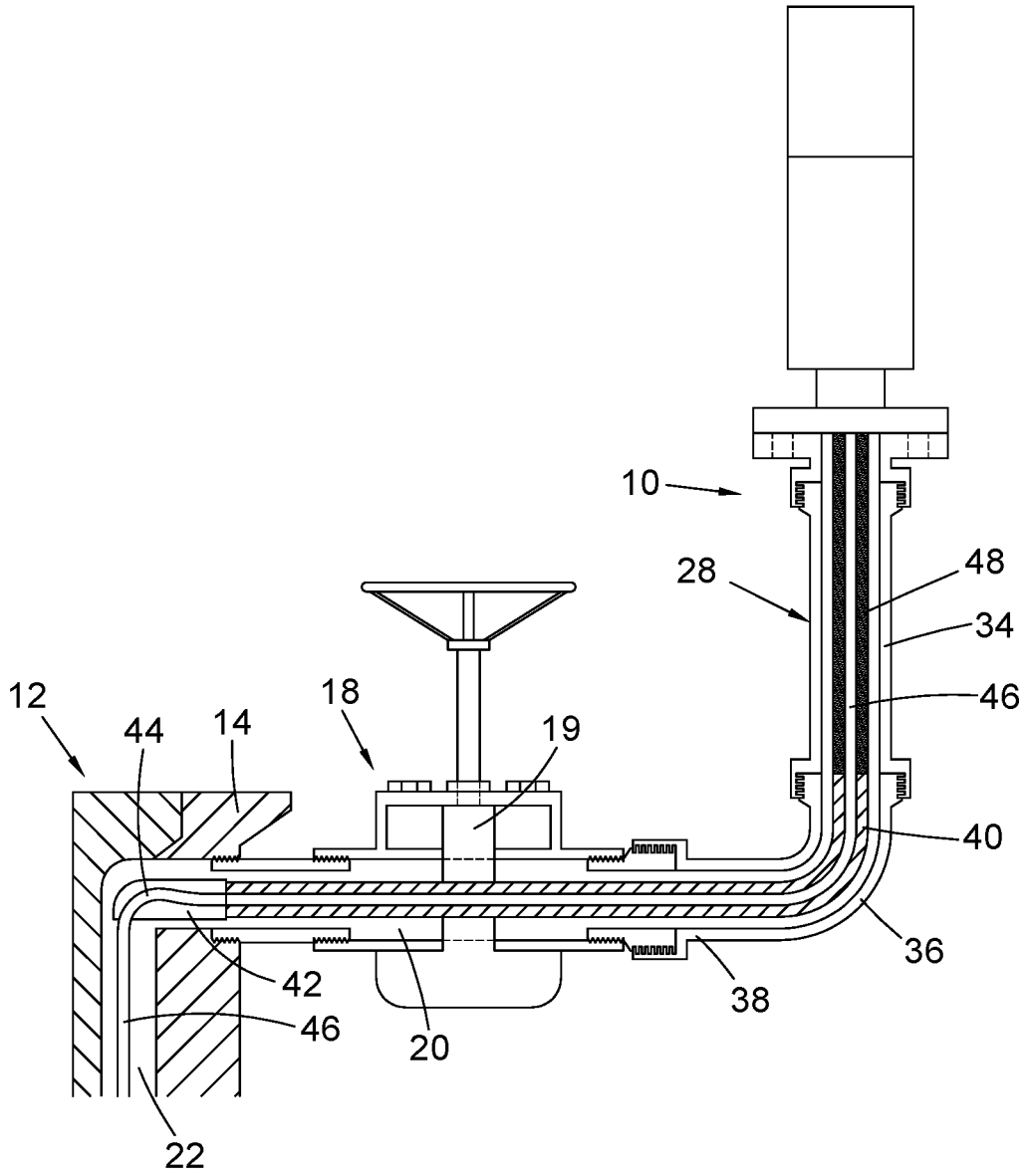
FIG. 2 is a view similar to FIG. 1 showing the intervention apparatus in a position for running a flexible conduit into a well.

The drive mechanism is configured to advance the flexible guide pipe 40 from a rear position as shown in FIG. 1 over a certain stroke length to a forward position as shown in FIG. 2, and to retract it again when desired. As seen in FIG. 2, a hollow shaft 48 of the top up tool 32 is forwardly advanced, or stroked, and the outer pipe 28 is forwardly advanced, together with the bending head 42. In this position, the bending head 42 extends through the side opening 16 in the outer wall 14 of the well 12, having advanced from a rearward position in the second straight portion 38 of the outer pipe 28 when the apparatus is in the retracted position, through the passageway 20 of the open valve 18, to a forward position in the side opening 16.

The apparatus 10 is configured to be exposed to pressure in the well annulus 22 when the valve 18 is opened. Thus the pathway through the apparatus 10 for the flexible conduit 46 is sealed with respect to the outside environment. This is achieved by the flexible conduit 46 extending through a seal (not shown) into the hollow shaft 48 of the top up tool 32.

The operation of the intervention apparatus will now be described. The apparatus 10 is set up with the bending head 42 located in the second straight portion 38 of the outer pipe 28, and with the flexible guide pipe 40 extending rearwardly from the bending head 42 around the bent portion 36 of the outer pipe 28 and along the first straight portion 34 of the outer pipe. Therefore, a front part of the flexible guide pipe 40 is deformed around the bend in the bent portion 36, so that this front part itself has a corresponding bend. The hollow shaft 48 of the top up tool 32 is retracted inside the top up tool. The outer pipe 28 is attached to the valve 18 when in the closed condition. This is seen in FIG. 1.

When it is desired to run the flexible conduit 46 into the annulus 22 of the well 12, the valve 18 is opened. The top up tool 32 is operated to advance forwardly the hollow shaft 48 which pushes on the flexible guide pipe 40 to move it forwardly. The flexible guide pipe 40 is pushed around the bend in the bent portion 36 of the outer pipe, so that the bend in the front part of the flexible guide pipe 40 moves rearwardly along the length of the flexible guide pipe 40 towards its rear. Therefore, as seen in FIG. 2, a rear part of the flexible guide pipe 40 is deformed around the bend in the bent portion 36 of the outer pipe 28, so that this rear part itself has a corresponding bend.

Meanwhile, as the flexible guide pipe 40 is forwardly advanced by the hollow shaft 48, it pushes on the bending head 42 which is also forwardly advanced, from the second straight portion 38 of the outer pipe 28, through the valve 18 and through the side opening 16 in the outer wall 14 of the well 12. At this stage a front end of the guide passage 44 of the bending head 42 is located in the annulus 22 and points generally downwardly.

A path for the flexible conduit 46 into the well annulus 22 is thus created. The flexible conduit 46 is advanced by an injector or the like (not shown) through the hollow shaft 48 of the top up tool 32, along the flexible guide pipe 40, through the valve 18, through the bending head 42 and into the annulus 22.

Due to the fact that the flexible guide pipe 40 is flexible, it is able to deform around the bend in the bent portion 36 of the outer pipe. It is configured to be pushed forwardly, in this embodiment by the hollow shaft 48 of the top up tool 32, and to push on the bending head 42 so that is advanced to form a path to the well annulus 22. A rearward part of the outer pipe 28, in this case the first straight portion 34, is orientated perpendicularly to the lateral access passage of the well 12. This enables the apparatus to occupy a relatively small space in a radial direction with respect to the well 12.

In this embodiment, the outer pipe 28 is bent between the horizontal direction of the lateral access passage and a vertical direction. However, it could also be bent in any direction relative to the radial direction of the lateral access passage. For example it could be bent in any direction in a plane perpendicular to the lateral access passage. Thus, rather than the first straight part 34 at the rear of the outer pipe 28 extending vertically, it could extend horizontally, or at an intermediate position between vertical and horizontal.

In this embodiment, the outer pipe 28 is bent with a 90° bend. However it could be bent by different angles whilst still reducing the space required by the apparatus 10 with respect to the radial direction of the well.

Figure 3:
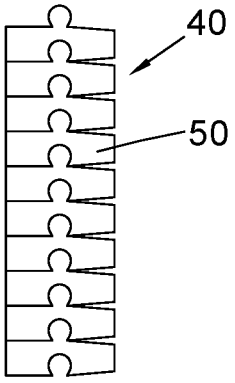
FIG. 3 is a schematic view of an alternative design of flexible guide pipe, in a straight condition.
Figure 4:
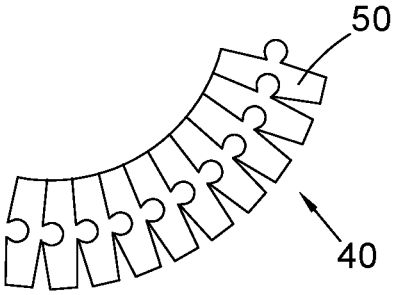
FIG. 4 is a schematic view of the flexible guide pipe of FIG. 4, in a bent condition.

In the embodiment of FIGS. 1 and 2, the flexible guide pipe 40 could be a pipe made of a suitable polymer, with or without steel reinforcement. FIG. 3 shows an alternative in which the flexible guide pipe 40 is made up of a plurality of rigid segments (or knuckles) 50 which are movable relatively to each other so as to be able to adopt a deformed shape around the bend. This may be desirable in some applications.

The invention claimed is:

1. An intervention apparatus for gaining lateral access to a well via a lateral access passage of the well, comprising:

an outer pipe and a flexible guide pipe for guiding a flexible conduit towards the lateral access passage, the flexible guide pipe being arranged to be forwardly advanced in the outer pipe and to deform around a bend in the outer pipe as it is forwardly advanced; and a bending head in front of the flexible guide pipe to direct the flexible conduit into the well from a direction of lateral insertion to another direction;

wherein the bending head has a guide passage for receiving the flexible conduit and having a bend therein to deviate the flexible conduit as it enters the well; and wherein the guide passage has a rear portion extending forwardly and with a radially outward component with respect to a longitudinal centerline of the bending head, and a front portion which extends forwardly and curves radially inwardly across the longitudinal centerline to terminate so as to exit the bending head pointing in a direction with a radially outward component.

2. The intervention apparatus as claimed in claim 1, wherein the bend in the guide passage is configured to deviate the flexible conduit from the direction of lateral insertion to a generally downward direction.

3. The intervention apparatus as claimed in claim 1, configured so that when the flexible guide pipe is in a retracted position prior to forward advancement, a front part of the flexible guide pipe is located in the bend in the outer pipe.

4. The intervention apparatus as claimed in claim 1, configured so that when the flexible guide pipe is in a forwardly advanced position after forward advancement, a rear part of the flexible guide pipe is located in the bend in the outer pipe.

5. The intervention apparatus as claimed in claim 1, further comprising a tool located rearwardly of the flexible guide pipe and arranged to forwardly advance the flexible guide pipe in the outer pipe.

6. The intervention apparatus as claimed in claim 1, further comprising the flexible conduit.

7. A method for gaining lateral access to a well via a lateral access passage of the well, comprising:

connecting intervention apparatus to the well, the intervention apparatus comprising an outer pipe and a flexible guide pipe, forwardly advancing the flexible guide pipe in the outer pipe towards the well such that the flexible guide pipe deforms around a bend in the outer pipe as it is forwardly advanced, and guiding a flexible conduit along the flexible guide pipe towards the lateral access passage;

wherein a bending head in front of the flexible guide pipe is forwardly advanced by the flexible guide pipe, and wherein the bending head directs the flexible conduit into the well from a direction of lateral insertion to another direction; and wherein the bending head has a guide passage for receiving the flexible conduit and having a bend therein, and wherein the bend in the guide passage deviates the flexible conduit as it enters the well; and deviating the flexible conduit in the bend in the guide passage to a generally downward direction; and wherein the guide passage has a rear portion extending forwardly and with a radially outward component with respect to a longitudinal centerline of the bending head, and a front portion which extends forwardly and curves radially inwardly across the longitudinal centerline to terminate so as to exit the bending head pointing in a direction with a radially outward component, said pointing direction being said generally downward direction.

8. The method as claimed in claim 7, wherein in a retracted position prior to forward advancement, a front part of the flexible guide pipe is located in the bend in the outer pipe.

9. The method as claimed in claim 7, wherein in a forwardly advanced position after forward advancement, a rear part of the flexible guide pipe is located in the bend in the outer pipe.

10. The method as claimed in claim 7, comprising forwardly advancing the flexible guide pipe in the outer pipe using a tool to push the flexible guide pipe forwardly.

* * * * *